US005507041A

United States Patent [19]

Wright

[11] Patent Number: 5,507,041

[45] Date of Patent: Apr. 16, 1996

[54] NEEDLE HOLDING APPARATUS AND METHOD OF USE

[76] Inventor: Robert C. Wright, 8135 LaPlace Ct., Westminster, Colo. 80030

[21] Appl. No.: 269,772

[22] Filed: Jul. 1, 1994

[51] Int. Cl.[6] ..... D05B 91/04

[52] U.S. Cl. ..... 2/21; 223/101

[58] Field of Search ..... 2/16, 170, 21; 223/101; D3/29; D11/26

[56] References Cited

U.S. PATENT DOCUMENTS

| | | | |
|---|---|---|---|
| 926,040 | 6/1909 | Weigle . | |
| 1,109,457 | 9/1914 | Pike | 223/101 |
| 1,174,887 | 4/1916 | Meriwether . | |
| 1,301,093 | 4/1919 | Bradford | 223/101 |
| 1,379,777 | 5/1921 | Oijerholm | 223/101 |
| 2,176,052 | 10/1939 | Beyer . | |
| 2,348,962 | 5/1944 | Davis | 2/21 |
| 2,415,957 | 2/1947 | McCormack | 223/101 |
| 2,436,607 | 2/1948 | Rosenthal . | |
| 2,536,979 | 1/1951 | Furedi . | |
| 2,605,032 | 7/1952 | Hunt et al. . | |
| 2,824,681 | 2/1958 | Sorkin | 2/170 |
| 3,371,561 | 3/1968 | Fabricant | 2/21 |
| 3,473,991 | 10/1969 | Ludwig . | |
| 3,511,242 | 5/1970 | Agnone | 2/21 |
| 3,636,568 | 1/1972 | Stuner | 2/161.6 |
| 3,835,664 | 9/1974 | Nesbit | 63/15.6 |
| 4,149,661 | 4/1979 | Curtiss | 223/101 |
| 4,174,620 | 11/1979 | Russell | 63/1 R |
| 4,643,341 | 2/1987 | Hostetler | 223/101 |
| 4,899,916 | 2/1990 | Townsend | 223/101 |
| 4,955,515 | 9/1990 | Brull | 2/21 |
| 4,985,038 | 1/1991 | Lyell | 2/21 |
| 5,196,818 | 4/1993 | Anderson | 335/285 |

*Primary Examiner*—Amy B. Vanatta
*Attorney, Agent, or Firm*—Brian D. Smith

[57] ABSTRACT

A method and apparatus are disclosed for handling a needle to reduce the likelihood of accidental pricking. The apparatus includes cylindrical sleeve for receiving a phalanx of a finger or thumb. The apparatus also includes a pair of planar magnetic surfaces supported on the cylindrical sleeve for removably holding a needle thereon. The surfaces are spaced from and flush with each other. The spacing between the planar surfaces allows the needle to be easily placed on or removed from the surfaces with the aid of a needle grasping tool. The device further includes a shield located to one side of the spaced planar magnetic surfaces to protect the wearer from accidental pricking when the needle is being placed onto, removed from, or held by the magnetic planar surfaces. The method includes placing the cylindrical sleeve on the phalanx of a finger or thumb so that the shield is closer to the proximal end of the phalanx or thumb and the planar surfaces are closer the distal end of the phalanx or thumb, placing the needle on the spaced planar magnetic surfaces, and removing the needle from the spaced planar magnetic surfaces. If worn on a finger, the cylindrical sleeve is preferably rotated so that the planar magnetic surfaces face away from the side of the finger.

19 Claims, 2 Drawing Sheets

NEEDLE HOLDING APPARATUS AND METHOD OF USE

TECHNICAL FIELD OF THE INVENTION

This invention is generally directed to devices for handling needles and, more particularly, to a surgeon's needle holder that reduces the likelihood of needle pricking while handling the needle.

BACKGROUND OF THE INVENTION

The explosive growth in the number of people suffering from Acquired Immune Deficiency Syndrome (AIDS) in recent years has made health care workers increasingly concerned about the risk of acquiring HIV and other blood contaminating infections, such as hepatitis, while performing their health care tasks.

For example, surgeons have a high risk of blood contamination when handling a suture needle used to suture an incision or repair an organ. Studies have shown that surgeons sustain scores of needle sticks per year while handling suture needles. To reduce this risk, some surgeons currently transfer the suture needle from the needle driver (used to drive the needle through the skin or organ being repaired) to another instrument, such as suture forceps, to avoid directly handling the needle.

Surgeons also sometimes require use of both hands and need to conveniently and safely keep the needle temporarily out of the way. In this situation, the surgeon typically releases the needle and leaves it surgeon typically releases the needle and leaves it dangling nearby to perform the task with his hands free. During this process, however, the surgeon may accidentally prick himself or herself with the needle with the dangling needle. Pricking also occasionally occurs when the surgeon is attempting to re-grasp the needle after performing the two handed task. In view of the foregoing, a need exists for a device that a surgeon can wear which enables the surgeon to conveniently hold a suture needle in a safe and accessible out of the way place when the surgeon needs or desires to have both hands free while performing a task.

It would be desirable if such a device could be worn on the surgeon's hand. It would further be desirable if a needle could easily be placed on, held by, and removed from the device. This would allow the surgeon to freely use one or both of his hands with the needle safely and conveniently out of the way until the surgeon needed to re-grasp the needle. It would be even more desirable if the device had a protective shield for shielding a finger or thumb upon which the device was worn from the needle when the needle was being placed onto, removed from, or held by the device.

Such a device would benefit the surgeon while performing a task requiring use of both hands, such as tying a suture knot. The device would, for example, allow the needle to be conveniently and securely held out of tile way while the surgeon tied the knot. After tying the knot, the surgeon could conveniently remove the needle from the device and continue another task involving the needle.

Of course, such a device would be advantageous to anyone needing to conveniently and safely hold any type of sewing needle temporarily out of the way, to free up both of their hands to perform a task, and need not be limited to use only by a surgeon.

DISCLOSURE OF THE INVENTION

The present invention addresses the aforementioned needs by providing a surgeon's needle holder for reducing the likelihood of pricking oneself while handling a needle. In its broadest sense, the surgeon's needle holder includes phalanx receiving means for receiving a phalanx of a wearer's selected finger or thumb, and needle holding means for removably holding a needle. The surgeon's needle holder of the present invention is further provided with shield means for shielding the received finger or thumb from a needle being placed on, removed from or held by the holding means to reduce the likelihood of a wearer pricking their said finger or thumb with the needle. In a preferred embodiment of the present invention, the phalanx receiving means comprises a cylindrical sleeve having an oval cross-sectional shape to fit on a distal phalanx of a selected finger or thumb. Alternatively, the sleeve may have a circular shape to fit the middle phalanx of a selected finger, or the distal phalanx of a selected finger or thumb. In the preferred embodiment of the present invention, the phalanx receiving means defines an outwardly facing base surface and the needle holding means is affixed to the base surface. Additionally, the shield means projects outwardly from the base surface from one side of the needle holding means.

Furthermore, the sleeve and the shield means are made from plastic or nonmagnetic metal, and the needle holding means magnetically holds the needle. In this manner, the needle is magnetically drawn to the needle holding means without interference by the shield means or the sleeve.

Preferably, the needle holding means includes first and second generally planar magnetic surfaces that are generally flush with each other and spaced apart to define a gap between them. The gap allows a needle to be easily removed from the planar surfaces by allowing the needle to be reached with the head of a needle gripping tool, such as a needle driver, placed within the gap.

The phalanx receiving means also preferably terminates in a distal edge and a proximal edge, the distal edge facing the distal end of the selected finger or thumb, and the proximal edge facing the proximal end of the selected finger or thumb, when the surgeon's needle holder is worn in its intended orientation. The needle holding means projects from the phalanx receiving means closer to its distal edge, and the shield means projects from the phalanx receiving means closer to its proximal edge in the preferred embodiment of the present invention. The shield means thus prevents a needle being placed on, removed from or held by the holding means from extending beyond the proximal edge of the sleeve.

The present invention further provides a method for handling a needle to reduce the likelihood of pricking oneself. The method includes the step of providing a surgeon's needle holder having a phalanx receiving means for receiving a phalanx of a wearer's finger or thumb. The needle holder further includes needle holding means for removably holding a needle and shield means for shielding a received finger or thumb from a needle being placed on, removed from or held by the holding means.

The method further includes inserting a finger or thumb phalanx into the phalanx receiving means of the surgeon's needle holder so that the shield means of the surgeon's needle holder is adjacent the proximal end of the phalanx with the needle holding means closer to the distal lend of the phalanx than the shield means. The method also includes placing a needle on the needle holding means of the surgeon's needle holder so that the needle is held by the needle holding means, and removing the needle from the needle holding means.

In a preferred method of the present invention, the step of removing the needle from the needle holding means is accomplished by grasping the needle with a needle holding tool. Additionally, when worn on a finger, the surgeon's needle holder is turned so that the needle holding means faces away from a radial side of the finger.

BRIEF DESCRIPTION OF THE DRAWINGS

Other features of this invention will appear in the following description and appended claims, reference being made to the accompanying drawings forming a part of the specification where like referenced characters designate corresponding parts of the views.

BEST MODE FOR CARRYING OUT THE INVENTION

Figure 1:
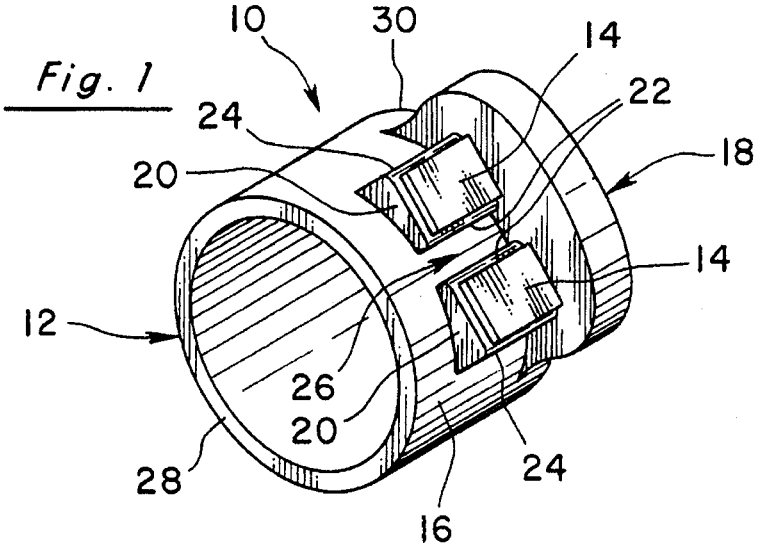
FIG. 1 is an isometric view of a surgeon's needle holder of the present invention.

FIGS. 1 through 5 illustrate a surgeon's needle holder 10 of the present invention. FIG. 6 illustrates the surgeon's needle holder 10 being worn on the distal phalanx of a wearer's left-hand index finger. As shown in FIG. 6, the surgeon's needle holder 10 enables the wearer to handle a needle with reduced likelihood of accidental pricking. Particularly, the surgeon's needle holder 10 enables the wearer to conveniently hold a needle safely out of the way at a time that the wearer needs or wants to free both hands.

FIGS. 1 through 5 illustrate a surgeon's needle holder 10 itself, before being worn. As seen in each of these figures, the surgeon's needle holder 10 is provided with a cylindrical sleeve, or phalanx receiving means, 12 sized and configured to receive a phalanx of a selected finger or thumb, as will be described in greater detail herein.

FIGS. 1 through 3, and 5 illustrate a pair of magnetized planar surfaces 14 affixed to an outer facing surface 16 of the cylindrical sleeve 12. The planar surfaces 14, or needle holding means, as illustrated in FIG. 6 and as will be described in greater detail herein, allow a needle to be removably held thereon when it is desirable to keep the needle accessible but out of the way of either of the person's hands.

FIGS. 1 through 5 illustrate a shield, or shield means, 18 projecting from the outer surface 16 of the cylindrical sleeve 12. As shown in these figures, the shield 18 is located off to one side of the planar surfaces 14. As shown in FIG. 6, the shield 18, protects the finger or thumb received by the phalanx receiving means 12 from a needle being placed on, removed from or held by the holding means to reduce the likelihood of a wearer pricking their said finger or thumb with the needle. Now that the basic elements of the surgeon's needle holder 10 of the present invention have been described, the elements will be discussed in greater detail.

Figure 2:
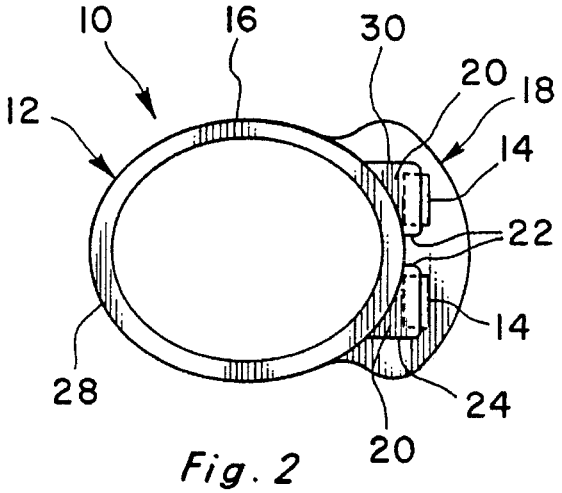
FIG. 2 is a front elevation view of a surgeon's needle holder of the present invention.
Figure 4:
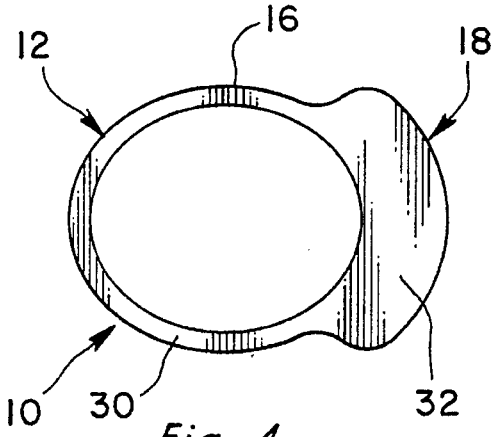
FIG. 4 is a back view of a surgeon's needle holder of the present invention.
Figure 5:
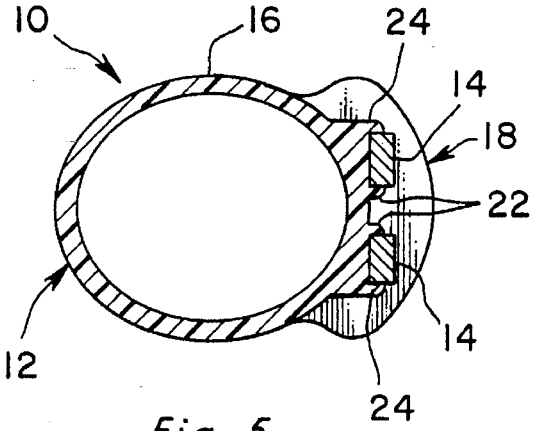
FIG. 5 is a vertical sectional view, taken along the line 5—5 of FIG. 3, showing the relative spacing of the phalanx receiving means, the needle holding means, and the shield means of the present invention.
Figure 6:
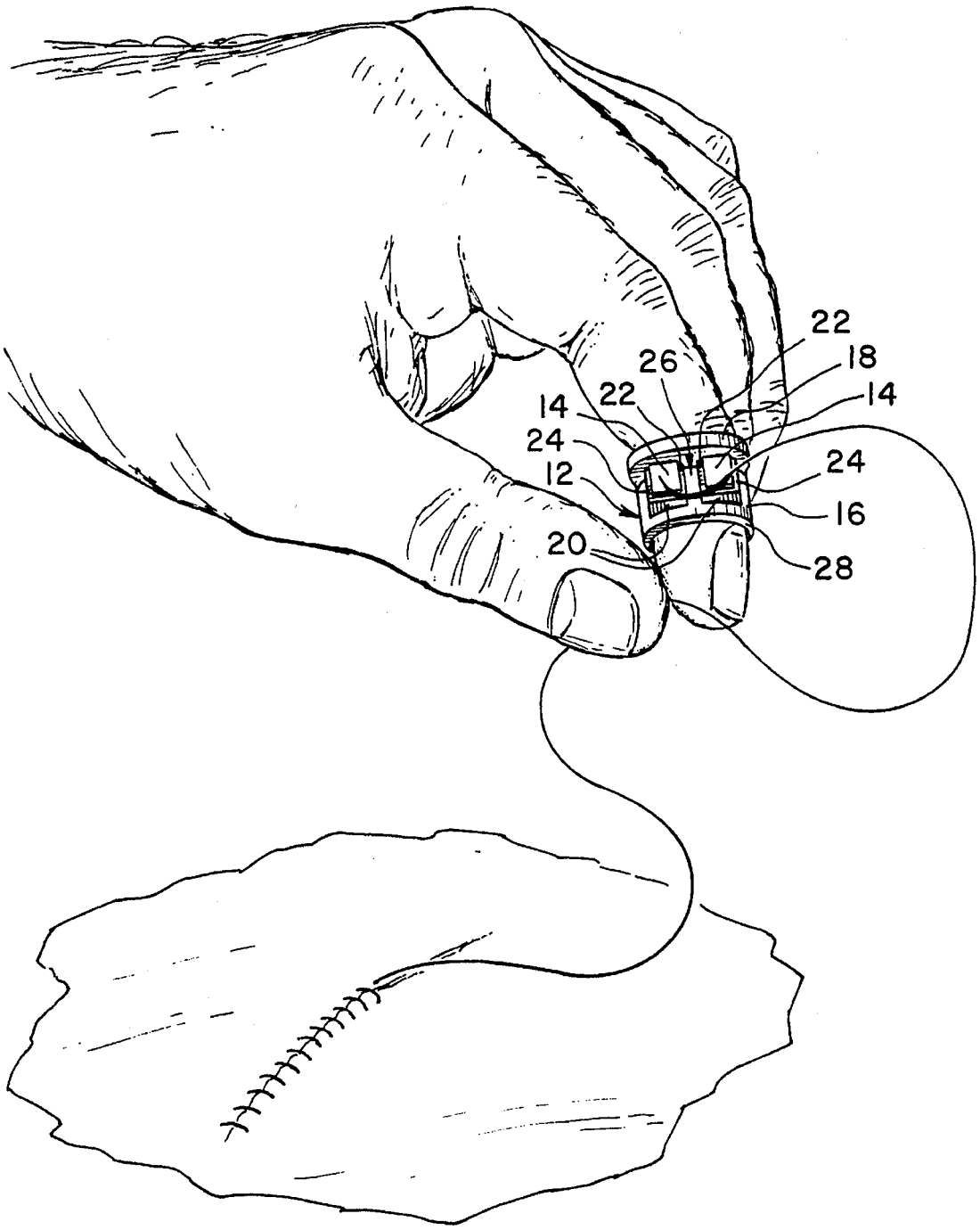
FIG. 6 is a partial isometric view of a surgeon's needle holder of the present invention being worn on the distal phalanx of a wearer's index finger, showing the shield means adjacent the proximal end of the distal phalanx and the needle holding means facing away from a radial side of the index finger.

The cylindrical sleeve 12 comprising the phalanx receiving means of the surgeon's needle holder 10, as best illustrated in FIGS. 2, 4 and 5, has an oblong cross-sectional shape. This oblong shape is provided so that the cylindrical sleeve 12 comfortably and snugly fits around a distal phalanx of a selected finger or thumb. The distal phalanx, unlike a proximal phalanx, is more narrow from nail to finger-pad than it is from side to side. It will be appreciated that a more circular cross-sectional shape could also be used, particularly for a surgeon's needle holder designed to fit on a proximal or middle phalanx of a finger, or proximal phalanx of a thumb. Preferably, however, as shown in FIGS. 2 and 4 through 6, the cylindrical sleeve 12 is configured to fit on the distal phalanx of the selected finger. This placement reduces the likelihood of needle pricking by requiring the least amount of travel of the needle in being placed on the magnetic planar surfaces 14. It will be appreciated that the invention will function, however, whatever the selection of phalanx for which the cylindrical sleeve is intended and designed to fit over.

As best shown in FIGS. 1 and 6, the length of cylindrical sleeve 12 is greater than that of a typical finger ring. The cylindrical sleeve 12 must be of sufficient length to act as a base for the shield 18 and for the planar surfaces 14 to rest upon. The cylindrical sleeve 12 is preferably made from a nonmagnetic material such as aluminum or a suitable hospital grade hard plastic so that it does not magnetically interfere with the needle holding means provided by the magnetic planar surfaces 14 by attracting the needle.

Figure 3:
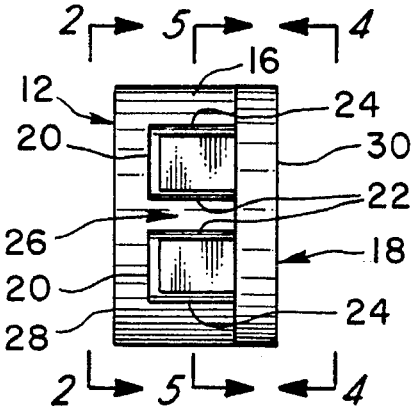
FIG. 3 is a side elevation view of a surgeon's needle holder of the present invention.

As best illustrated in FIGS. 1 through 3, the magnetic planar surfaces 14 rest upon and are affixed to the outer surface, or outwardly facing surface, 16 of cylindrical sleeve 12. The outwardly facing surface 16 thus acts as a base surface for the needle holding means provided by the magnetic planar surfaces 14.

More specifically, each magnetic planar surface 14 is supported by a housing, or support means, (not numbered) shown integrally formed with and extending from the outer surface 16. The housing is also comprised of a nonmagnetic material such as aluminum or a suitable plastic, so as not to magnetically interfere with the magnetic planar surfaces 14. As shown, each housing includes a side wall 20, a first edge wall 22 and a second edge wall 24. The housing walls are shown integrally formed with one another and with the outer surface 16 of the cylindrical sleeve 12. This is particularly beneficial when the cylindrical sleeve 12 and the housing are comprised of plastic, since they can both be manufactured from a single injection mold (and also the shield 18, when also comprised of plastic.)

The housings are each configured to result in the planar surfaces 14 being flush with each other so that the needle rests flatly upon the planar surfaces 14. Therefore, as best shown in FIGS. 1, 2 and 5, each side wall 20 has a curved bottom edge (not numbered) that follows the curved contour of outer surface 16. Also, as best shown in FIGS. 2 and 5, the first edge wall 22 of each housing is shorter than the respective second edge wall 24 to adjust for the curvature of the cylindrical sleeve 12 so that the magnetic planar surfaces 14 are situated levelly and flush with one another. As seen, the edge walls 22, 24 do not need to have curved bottom edges if the outer surface 16 is generally flat along its longitudinal dimension. FIGS. 2 and 5 best illustrates the levelness and flushness of the magnetic planar surfaces 14 with each other. It will be appreciated that the needle may thus rest flatly upon the flush planar surfaces 14 to maximize its contact with the planar surfaces 14 and thus increase the hold upon the needle created by the magnetic planar surfaces.

Each of the magnetic planar surfaces 14 is shown inlaid into its respective housing. As can be seen, the planar surfaces 14 are shown raised with respect to the top of the housing to avoid the housing structure from interfering with the placement or removal of the needle from the planar surfaces 14. Also, for clarity, the planar surfaces 14 are shown exaggeratedly raised and having an exaggeratedly small surface area in the Figures.

It will be appreciated that the housings may be conventionally manufactured and the planar surfaces 14 held thereby in many other ways. It will also be appreciated that the housing/magnetic planar surface 14 combination, may consist of one integral structure having the features illustrated in the drawings herein. It is contemplated that the planar surfaces 14 need not necessarily be magnetized, but may have an adhesive or other holding agent thereon, or a groove notched therein into which the needle may be placed to hold the needle.

As also shown in FIGS. 1 through 3 and 5, the housings are spaced apart from one another to define a gap 26. With the magnetic planar surfaces 14 supported by the spaced support structures, the gap 26 eases the removal of the needle from the magnetic planar surfaces 14 by allowing the needle shaft to be grabbed with a needle grasping tool, such as suture forceps or a needle driver. The gap 26 is sized to be large enough to fit the head of such a tool so that the tool head may be placed within the gap and the needle may be grasped with the tool. The gap 26 would also ease the removal of the needle with fingers of a hand, as well, and also facilitates the placement of the needle onto the magnetic planar surfaces 14.

As shown in FIGS. 1 through 5, the cylindrical sleeve 12 has a pair of ends 28 and 30. End 28 is designated the distal end because it faces the distal end of the finger or thumb when the surgeon's needle holder 10 is worn as intended and as illustrated in FIG. 6. End 30 is designated the proximal end because it faces the proximal end of the finger or thumb when the surgeon's needle holder is worn as illustrated in FIG. 6.

In accordance with another important aspect of the present invention, the shield 18 is located closer to the proximal end 30 of the cylindrical sleeve 12 than are the magnetic planar surfaces 14, and the magnetic planar surfaces 14 are located closer to the distal end 28 of the cylindrical sleeve 12 than is the shield 18. As best shown in FIG. 3, the planar surfaces 14 abut the shield 18 so that no gap is created therebetween within which the needle could lodge. As best shown in FIGS. 3 and 4, the back 32 of shield 18 is aligned with the proximal end 30 of the cylindrical sleeve 12 in this embodiment. It will be appreciated, however, that planar surfaces 14 and the shield 18 need not be located as illustrated for the surgeon's needle holder 10 to function properly, but that the shield 18 be located closer to the proximal end 30 of the cylindrical sleeve 12 than the needle holding means (planar surfaces 14) of the surgeon's needle holder 10. As best illustrated in FIG. 1, the shield 18 is sized to a width greater than the spacing between the two second edge walls 24, and is sized to a height greater than the height of the side walls 20, so as to effectively shield against accidental pricking when the needle is being placed on, removed from, or held by the magnetic planar surfaces 14. The shield 18 comprises a nonmagnetic material such as aluminum or hospital grade plastic so as not to magnetically interfere with the magnetic planar surfaces 14.

To use the surgeon's needle holder 10, as illustrated in FIG. 6, cylindrical sleeve 12 is slid over the distal phalanx of a wearer's index finger with the shield 18 adjacent to the proximal end of the distal phalanx and the planar surfaces 14 closer to the distal end of the finger than the shield 18. The shield 18 thus protects the wearer from accidentally pricking himself or herself with the needle tip while placing the needle onto the planar surfaces 14. The cylindrical sleeve 12, as also illustrated in FIG. 6, is turned so that the planar surfaces 14 face away from a radial side of the finger to maximize the ease with which the needle can be placed on and removed from the surfaces 14. The hand illustrated in FIG. 6 is not shown wearing a surgical glove, as would actually be in the case of a surgeon wearer, in order to preserve anatomical detail. As will be appreciated, the surgeon's needle holder 10 may also be adapted to be worn on, and worn over, the middle or proximal phalanx of a finger or the proximal phalanx of a thumb. However, this increases the exposure of the received finger or thumb to the needle.

A surgeon can particularly find the surgeon's needle holder 10 useful while tying a suture knot. Typically, the surgeon uses a needle driver to drive a curved suture needle (not numbered) into and out of the incision or organ being sutured. After the needle tip has emerged from the incision or organ, the surgeon grasps the suture needle with the needle driver itself or a second needle grasping device, such as suture forceps, and pulls the suture through the path made by the suture needle. The surgeon then typically uses the needle driver to make the next loop (transferring the needle back to the needle driver, if necessary). When the surgeon is satisfied that a sufficient number of loops have been made in this fashion, he or she tightens the loops by pulling on the suture and prepares to tie the knot.

It is usually at this time that the surgeon can typically prick himself or herself with the needle tip, because the surgeon needs both hands free from the needle to work a knot in the suture line and the suture needle is usually just left dangling in the air. Sometimes, the surgeon just needs his or her dominant hand to do the task normally requiring both hands. Here, the surgeon usually holds the needle with the index finger and thumb of the non-dominant hand and may accidentally prick the non-dominant hand while so holding the needle. To alleviate the risk caused by either of these procedures, the surgeon can use the surgeon's needle holder 10 to provide a place where the needle can be conveniently and safely secured out of the surgeon's way while tying the knot.

More specifically, after the last loop is made, the surgeon can place the needle onto the magnetic planar surfaces 14 with the aid of the needle driver or suture forceps to safely and conveniently hold the needle out of the way. The surgeon by that safely frees up one hand and can then use one or both free hands to finish tying the suture knot in the manner well known in the art to surgeons. When the surgeon needs the needle again, he or she can remove it with the needle driver, or by hand, and continue a task or go to a next task requiring the needle. It will be appreciated that the surgeon's needle holder is not just useful to surgeons but will be useful to anyone who needs to temporarily and conveniently hold a needle safely out of the way while freely using one or both of their hands to do a task.

From the foregoing, it will be appreciated that a surgeon's needle holder is provided which reduces the likelihood of accidentally pricking oneself with a needle while handling the needle. It will be appreciated that the surgeon's needle holder can be worn on a phalanx of a finger or thumb and includes needle holding means for conveniently temporarily storing a needle safely out of the way of the wearer's hands to allow the wearer to freely use his hands with less likelihood of accidentally pricking himself with needle. It will further be appreciated that the surgeon's needle holder includes a protective shield located to one side of the needle holding means to protect the wearer from accidental pricking the finger or thumb upon which the surgeon's needle holder is worn with the needle when the needle is being placed onto, removed from, or held by the needle holding means.

While the above invention has been shown and described in detail in this application, it should be understood that this invention is not to be limited to the exact form disclosed and changes in detail and construction of the invention may be made without departing from the spirit thereof.

I claim:

1. A surgeon's needle holder comprising:

phalanx receiving means for receiving a phalanx of a wearer's finger or thumb, said phalanx receiving means defining an outwardly facing base surface;

needle holding means affixed to said base surface and having an outwardly facing surface for removably holding a needle; and shield means projecting outwardly from said base surface of said phalanx receiving means to one side of said needle holding means for shielding a finger or thumb received by the phalanx receiving means from a needle being placed on, removed from or held by said holding means to reduce the likelihood of a wearer pricking their said finger or thumb with the needle, said shield means projecting outwardly beyond said outwardly facing surface of said needle holding means.

2. A surgeon's needle holder as claimed in claim 1 wherein said phalanx receiving means is generally cylindrically shaped.

3. A surgeon's needle holder as claimed in claim 2 wherein said phalanx receiving means has an oblong cross-sectional shape.

4. A surgeon's needle holder as claimed in claim 1 wherein said phalanx receiving means is comprised of plastic.

5. A surgeon's needle holder as claimed in claim 1 wherein said phalanx receiving means is comprised of non-magnetic metal.

6. A surgeon's needle holder as claimed in claim 1 wherein said shield means is comprised of plastic.

7. A surgeon's needle holder as claimed in claim 1 wherein said shield means is comprised of non-magnetic metal.

8. A surgeon's needle holder as claimed in claim 1 wherein said needle holding means includes a magnetic surface for magnetically holding a needle.

9. A surgeon's needle holder as claimed in claim 1 wherein said needle holding means includes:

a first generally planar magnetic surface and a second generally planar magnetic surface, said first and second planar surfaces being generally flush with each other and spaced apart from each other to define a gap therebetween for facilitating the removal of a needle held by said first and second planar surfaces.

10. A surgeon's needle holder comprising:

phalanx receiving means for receiving a distal phalanx of a wearer's finger or thumb, said phalanx receiving means having an outer surface terminating in first and second opposed edges;

needle holding means projecting from said outer surface of said phalanx receiving means and having an outwardly facing surface for removably holding a needle; and shield means projecting from said outer surface of said phalanx receiving means from a position closer to one of said opposed edges of said phalanx receiving means than said needle holding means, said shield means for shielding the finger or thumb received by the phalanx receiving means from a needle being placed on, removed from or held by said holding means so as to reduce the likelihood of a wearer pricking a said finger or thumb with the needle, said shield means projecting outwardly beyond said outwardly facing surface of said needle holding means.

11. A surgeon's needle holder, as claimed in claim 10, wherein said needle holding means includes:

first and second generally planar surfaces; and support means disposed from said outer surface of said phalanx receiving means for supporting said first and second planar surfaces so that said planar surfaces are generally flush with each other and spaced apart from each other to define a gap therebetween for facilitating the removal of a needle held by said first and second planar surfaces.

12. A surgeon's needle holder, as claimed in claim 11, wherein said generally planar surfaces are magnetic.

13. A surgeon's needle holder, as claimed in claim 11, wherein each said planar surfaces is inlaid into said support means.

14. A surgeon's needle holder, as claimed in claim 11, wherein said support means is integral with said phalanx receiving means.

15. A surgeon's needle holder, as claimed in claim 11, wherein said support means is comprised of plastic.

16. A method of handling a needle to minimize or reduce the likelihood of pricking oneself with said needle, said method comprising the steps of:

providing a surgeon's needle holder including:

phalanx receiving means for receiving a phalanx of a wearer's finger or thumb;

needle holding means having an outwardly facing surface for removably holding a needle; and shield means projecting outwardly from said base surface of said phalanx receiving means to one side of said needle holding means for shielding a finger or thumb received by the phalanx receiving means from a needle being placed on, removed from or held by said holding means to reduce the likelihood of a wearer pricking a said finger or thumb with the needle, said shield means projecting outwardly beyond said outwardly facing surface of said needle holding means;

inserting a phalanx of a finger or thumb of a hand into the phalanx receiving means of the surgeon's needle holder so that the shield means of the surgeon's needle holder is adjacent the proximal end of the phalanx with the needle holding means closer to the distal end of the phalanx than the shield means;

placing a needle on the needle holding means of the surgeon's needle holder so that the needle is held by the needle holding means; and removing the needle from the needle holding means.

17. A method, as claimed in claim 16, wherein said step of removing the needle from the needle holding means is accomplished by grasping the needle with a needle holding tool.

18. A method, as claimed in claim 16, wherein the needle holding means includes a first generally planar magnetic surface and a second generally planar magnetic surface, said first and second planar surfaces being generally flush with each other and spaced apart from each other to define a gap therebetween for facilitating the removal of a needle held by said first and second planar surfaces, and wherein:

said step of placing the needle on the needle holding means is accomplished by placing the needle on the first and second generally planar magnetic surfaces; and said step of removing the needle from the needle holding means is accomplished by positioning a needle holding tool in the gap between the first and second planar magnetic surfaces and grasping the needle with the needle holder to remove the needle from the first arid second planar magnetic surfaces.

19. A method, as claimed in claim 16, wherein a finger is inserted into the phalanx receiving means in said step of inserting, and further including the step of:

turning the surgeon's needle holder so that the needle holding means faces away from a radial side of the finger.

* * * * *